US005455869A

United States Patent [19]

Miscavige

[11] Patent Number: 5,455,869

[45] Date of Patent: Oct. 3, 1995

[54] LAVALIER MICROPHONE ASSEMBLY

[75] Inventor: David Miscavige, Los Angeles, Calif.

[73] Assignee: Church of Scientology International, Los Angeles, Calif.

[21] Appl. No.: 183,570

[22] Filed: Jan. 18, 1994

Related U.S. Application Data

[63] Continuation of Ser. No. 805,316, Dec. 10, 1991, abandoned, which is a continuation of Ser. No. 495,759, Mar. 19, 1990, abandoned.

[51] Int. Cl.[6] ..... H04R 25/00

[52] U.S. Cl. ..... 381/169; 381/168

[58] Field of Search ..... 381/169, 205, 381/187, 188, 189, 168, 112, 113, 114, 115; 181/242, 158; 220/326; 206/305, 320

[56] References Cited

U.S. PATENT DOCUMENTS

| | | | |
|---|---|---|---|
| 2,296,454 | 9/1942 | Schauer | 381/169 |
| 2,554,113 | 5/1951 | McCreary | 381/169 |
| 4,088,848 | 5/1978 | Weed | 381/205 |
| 4,570,746 | 2/1986 | Das et al. | 381/158 |
| 5,191,314 | 3/1993 | Ackerman et al. | 340/542 |

FOREIGN PATENT DOCUMENTS

| | | | |
|---|---|---|---|
| 0019498 | 1/1984 | Japan | 381/169 |
| 0934325 | 8/1963 | United Kingdom | 381/169 |
| 0999236 | 7/1965 | United Kingdom | 381/169 |
| 1136794 | 12/1968 | United Kingdom | 381/169 |
| 1317112 | 5/1973 | United Kingdom | 381/169 |

*Primary Examiner*—Curtis Kuntz
*Assistant Examiner*—Huyen D. Le
*Attorney, Agent, or Firm*—Small Larkin & Kidde

[57] ABSTRACT

A lavalier microphone assembly wherein ambient and mechanical interference are minimized. The assembly comprises a lavalier microphone. The microphone includes a microphone casing having an aperture for the entry of sound waves and a transducer disposed within the casing near the aperture for conversion of sound waves into electrical signals. The assembly also comprises a cable, which is connected to the transducer for transmitting the electrical signals to a remote location for processing. The assembly further comprises a microphone cage which is attached to the cable and which surrounds the microphone. By surrounding the microphone, the cage both prevents the microphone from being inadvertently contacted and spaces the microphone from noises produced by the rustling of clothing. The cage is mounted on an article of clothing by means of a mounting pin, the mounting pin being fixedly mounted on the cage.

3 Claims, 3 Drawing Sheets

LAVALIER MICROPHONE ASSEMBLY

This is a continuation of application Ser. No. 07/805,316 filed on Dec. 10, 1991, which is a continuation of application Ser. No. 07/495,759, filed on Mar. 19, 1990, abandoned.

BACKGROUND OF THE INVENTION

1. Field of the Invention

The present invention relates generally to microphones and, more particularly, to "lapel" or "lavalier" microphones.

2. Description of Related Art

Microphones are electronic devices commonly used in the amplification and/or recording of sounds. Generally, a microphone comprises a microphone casing and a transducer. The microphone casing has an aperture for receiving sound vibrations. The transducer, which is used to convert the sound vibrations into electrical signals, is disposed within the casing near the aperture. In use, sound vibrations enter the microphone through the aperture and impinge on the transducer. The transducer then converts these sound vibrations into electrical signals, which are then transmitted to an amplifier for amplification. Typically, the amplifier is disposed at a remote location, and consequently, a microphone cable is used to transmit the signals from the microphone to the amplifier. After being amplified, the electrical signals are then transmitted either to a receiver, where the signals are converted back into audible sound, or to a recording device, where the signals are recorded on magnetic tape or other similar material.

Although they are indispensable to film and television-making, microphones are considered by most to be aesthetically displeasing. Consequently, considerable effort has been expended to find ways to make microphones less conspicuous to audiences without sacrificing the sensitivity of the microphones. One approach has been to hide or to camouflage the microphones so that they will not be seen by audiences but will still pick up the desired sounds. Another approach has been to have one or more of the actors wear a very small microphone, often called a "lapel" or "lavalier" microphone, on or under his clothing. Unfortunately, however, lavalier microphones create an entirely new problem, namely, interference. Microphone interference may be defined as that portion of sound output that is undesired. In general terms, it is sound picked up by the microphone and transmitted to the audience that is different from sound that would be heard by a person not hearing the sound through a microphone. Interference most common to lavalier microphones is caused either by the rustling of clothing in the immediate vicinity of the microphone or by direct physical contact with the microphone itself. It should be noted that these two forms of interference are in fact different. To illustrate this point, one may perform the following experiment.

First, the finger and thumb of one hand are rubbed together lightly near the waist. The sound produced by the rubbing is barely perceptible. If, however, the finger and thumb are rubbed together near the aural canal of the ear, the rubbing produces a loud scratching noise. Now, if the other hand is used to block the aural canal while the rubbing takes place, the sound again becomes imperceptible. However, if instead of rubbing together the finger and thumb, the finger is rubbed along the outer ear while the aural canal is closed, a loud scraping noise is again heard.

In the above-described experiment, the noise heard from rubbing together the finger and thumb near the aural canal is analogous to the interference produced by rubbing clothing together near the microphone. For purposes of this application, this type of interference will be referred to as "ambient interference." The noise heard from rubbing the finger along the outer ear while the aural canal is closed is analogous to the interference caused by physical contact with the microphone itself. For purposes of this specification and claims, this type of interference will be referred to as "mechanical interference."

In U.S. Pat. No. 3,651,286, issued to Gorike et al., there is disclosed a lavaliar microphone assembly designed to protect against frictional noises. The microphone assembly comprises a longitudinally elongated microphone capsule and a tubular casing, the capsule being fixedly mounted and supported within the casing at least at each end by an axially spaced resilient vibration absorbing member. The purpose of the absorbing members is to shield the microphone capsule from noise transmitted to the casing.

While the above-described Gorike assembly appears to address the problem of mechanical interference caused by contact with the microphone capsule, it does not address the problem of ambient interference, which is caused, for example, by the rubbing together of clothes in the vicinity of the microphone.

Other references of interest include U.S. Pat. No. 2,327,320, issued to H. B. Shapiro; U.S. Pat. No. 2,336,828, issued to W. A. Zarth; U.S. Pat. No. 2,351,400, issued to R. W. Carlisle; U.S. Pat. No. 2,505,551, issued to H. S. Knowles; U.S. Pat. No. 2,673,898, issued to P. Reichert.

SUMMARY OF THE INVENTION

It is an object of the present invention to provide a new and improved lavaliar microphone assembly.

It is another object of the present invention to provide a lavaliar microphone assembly which minimizes interference, particularly mechanical and ambient interference.

It is still another object of the present invention to provide a lavaliar microphone assembly as described above which is compact, which is lightweight, and which can be worn inconspicuously.

It is yet another object of the present invention to provide a lavaliar microphone assembly as described above which permits the lavalier microphone to be worn on or under clothing at any number of locations.

Additional objects and advantages of the invention will be set forth in part in the description which follows, and in part will be obvious from the description or may be learned by practice of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, a microphone cage for surrounding a lavaliar microphone that is connected to a microphone cable comprises a first concave frame section having a first end and a second end, a second concave frame section having a first end and a second end, means for hingedly connecting said first end of said first concave frame section to said first end of said second concave frame section, means for detachably connecting said second end of said first concave frame section to said second end of said second concave frame section, and means for securing said microphone cable between said first concave frame section and said second concave frame section.

Additionally, to achieve the foregoing objects and in accordance with the purpose of the invention, as embodied and broadly described herein, a lavalier microphone assembly constructed according to the teachings of the present invention, comprises a lavalier microphone, the microphone including a lavalier microphone casing having an aperture for receiving sound vibrations and a transducer disposed within the lavalier casing near the aperture for converting the sound vibrations into electrical signals, a microphone cable, the cable being connected to the transducer for transmission of the electrical signals to a remote location, and a microphone cage, the microphone cage adapted to be attached to the microphone cable while surrounding the microphone casing so as to minimize interference.

The accompanying drawings, which are hereby incorporated in and constitute a part of this Specification, illustrate the preferred embodiments of the invention and, together with the description, serve to explain the principles of the invention.

BRIEF DESCRIPTION OF THE DRAWINGS

In the drawings wherein like reference numerals represent like parts.

DETAILED DESCRIPTION OF THE PREFERRED EMBODIMENTS

The present invention is directed generally to a new and improved lavalier microphone assembly that minimizes interference, particularly ambient and mechanical interference.

Figure 1:
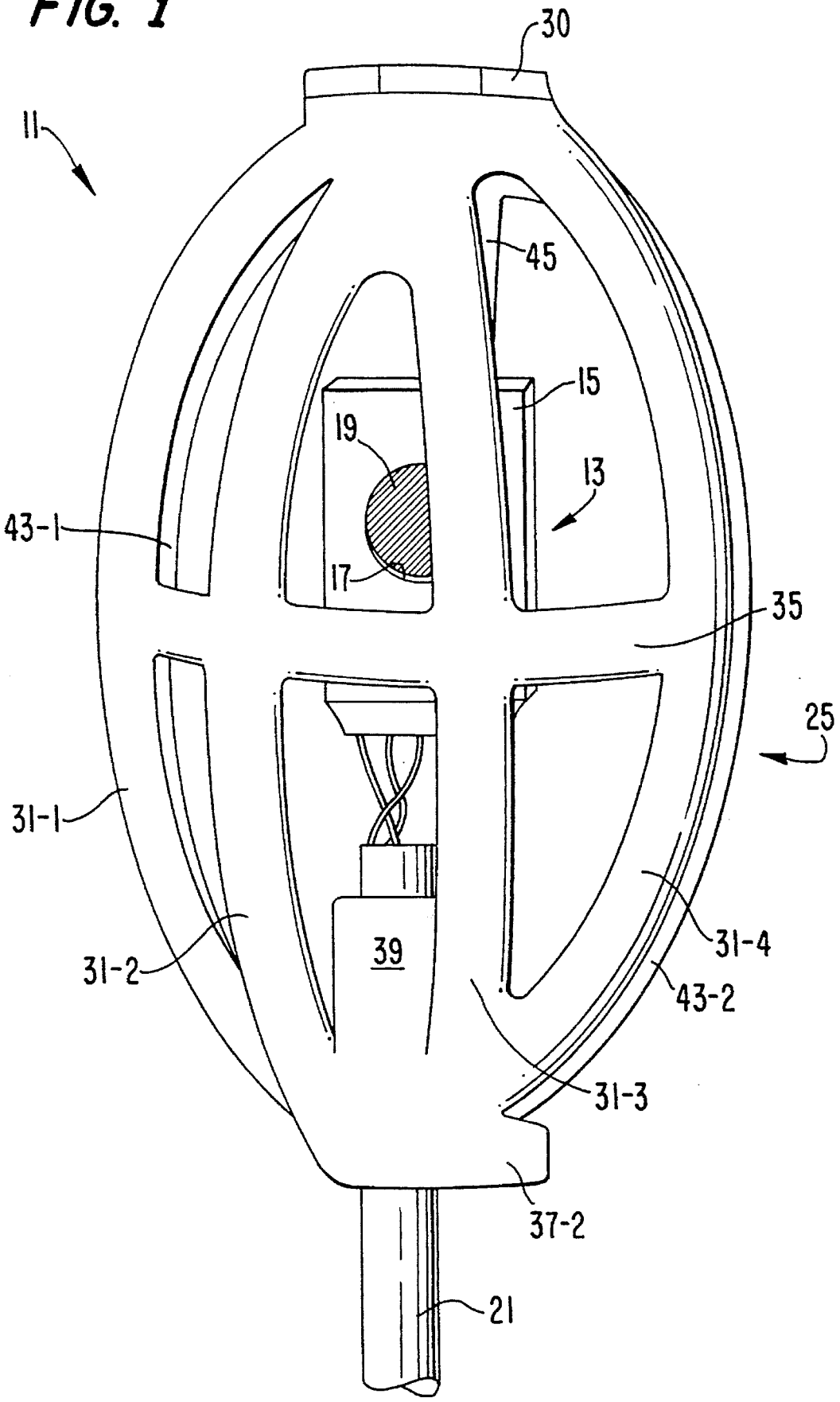
FIG. 1 is a front perspective view of one embodiment of a lavalier microphone assembly constructed according to the teachings of the present invention.
Figure 2:
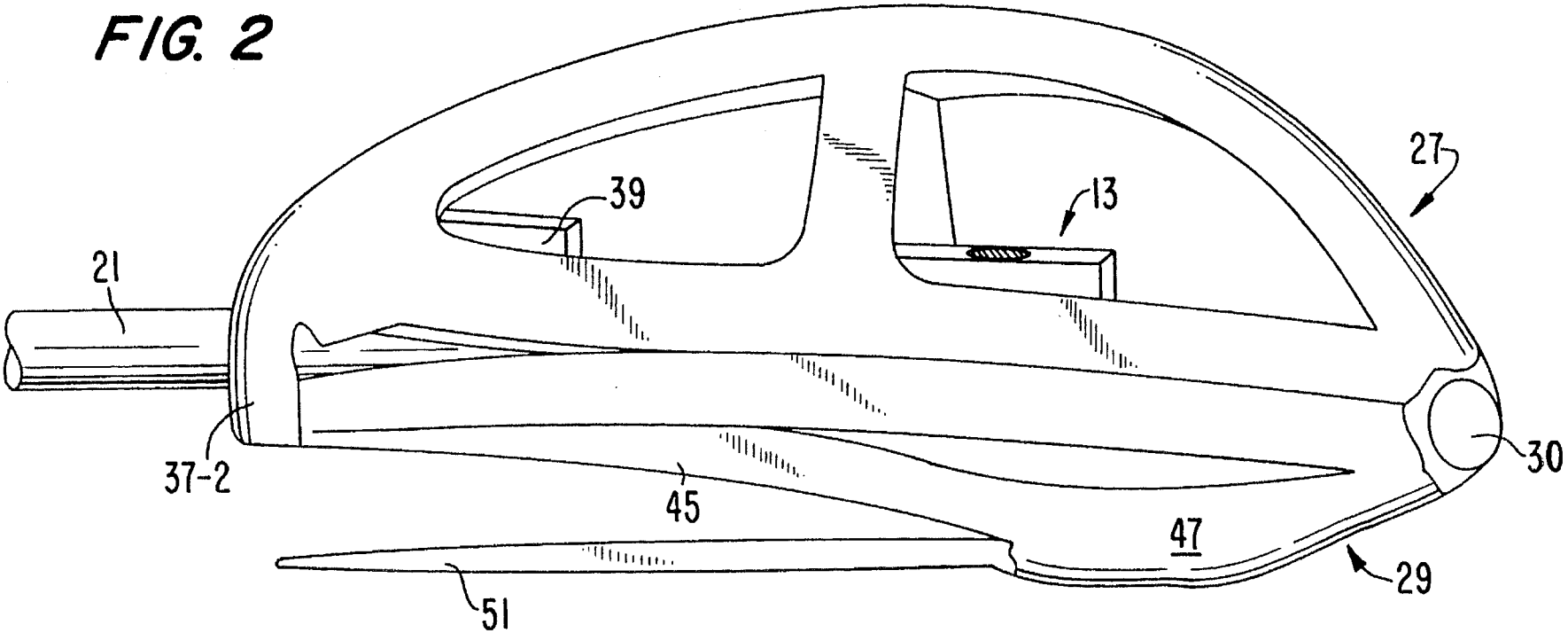
FIG. 2 is a perspective view taken from the right side of the lavalier microphone assembly of FIG. 1.

Referring now to the drawings and particularly to FIGS. 1 and 2, there is illustrated one embodiment of a lavalier microphone assembly which is constructed according to the teachings of the present invention, the lavalier microphone assembly being designated generally by reference numeral 11.

Lavalier microphone assembly 11 comprises a lavalier microphone designated generally by reference numeral 13. Microphone 13 includes a microphone casing 15 having an aperture 17 for receiving sound vibrations and a transducer 19 which is disposed within casing 15 near aperture 17 for the conversion of the sound vibrations into electrical signals. For purposes of illustration only, lavalier microphones having a size, shape and construction similar to the Crown® PZM™ 3LV microphone element have been found to be suitable for purposes of the present invention.

Lavalier microphone assembly 11 also includes a microphone cable 21. Microphone cable 21, which is connected at one end to transducer 19, transmits the electrical signals generated by transducer 19 to a remote location. At this remote location (not shown), there is typically an amplifier, which is used to amplify the electrical signals. To increase the mobility of a person wearing the lavalier microphone, the amplifier may be incorporated into a radio transmitter. The radio transmitter converts the electrical signals into radio waves and transmits them to a location where they are converted back into electrical signals and either recorded, such as on magnetic tape, or converted back into audible sound waves by a receiver.

Figure 3:
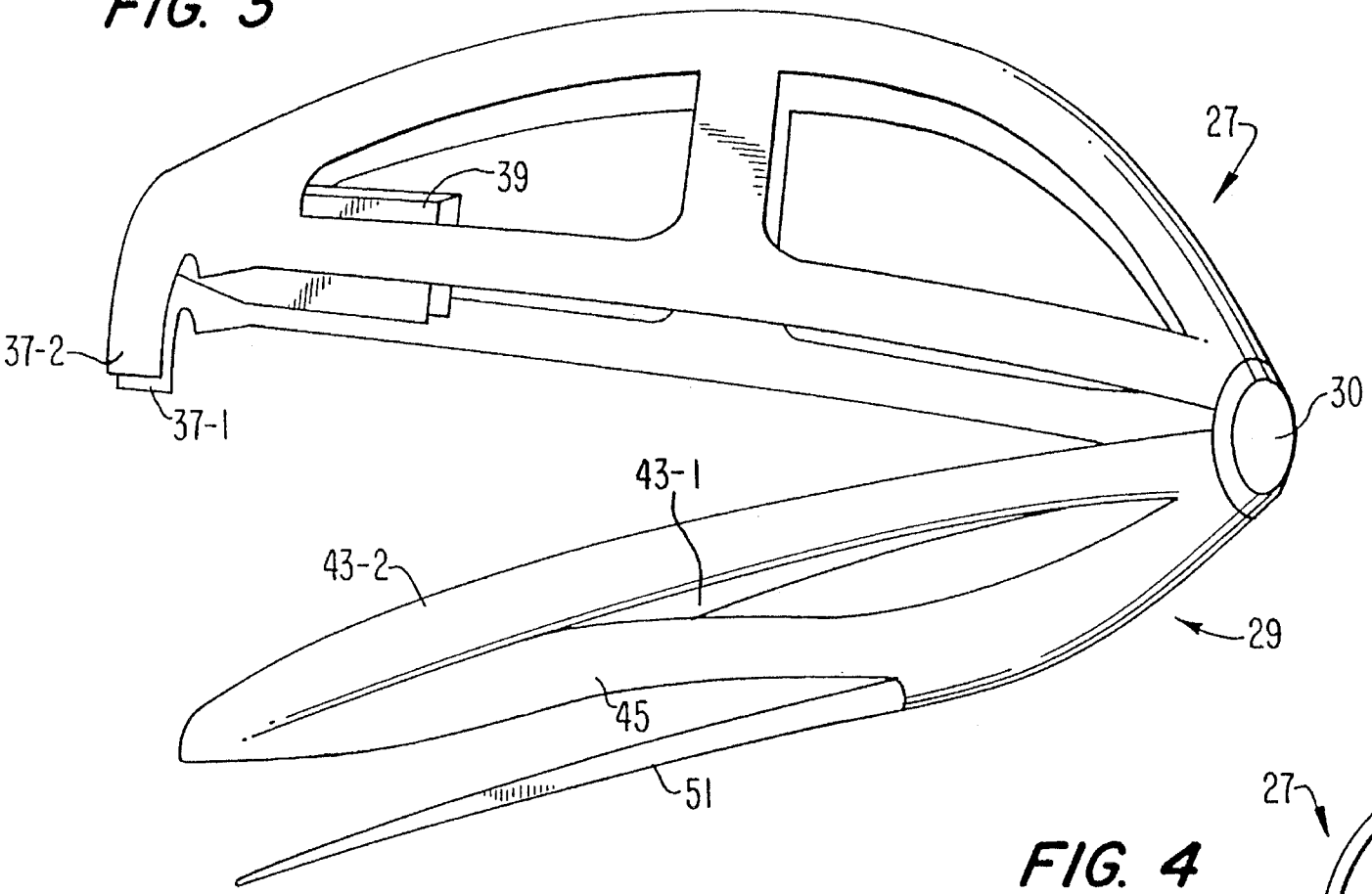
FIG. 3 is a perspective view taken from the right side of the microphone cage of the microphone assembly of FIG. 1, the microphone cage being shown in the open position.

Referring now to FIGS. 1 through 3, lavalier microphone assembly 11 further includes a microphone cage 25, which is adapted to be attached to cable 21 while surrounding microphone 13 so as to minimize interference. Microphone cage 25 comprises a concave front frame section 27 and a concave back frame section 29. Front section 27 and back section 29 are connected at their respective top ends by a hinge 30. Preferably, front section 27, back section 29 and hinge 30 are made of a lightweight yet durable material, such as technique metal (a brass alloy). Additionally, front section 27 and back section 29 are preferably coated with rubber or a similar silencing substance that serves to reduce friction with clothing.

Preferably, front section 27 is a unitary structure shaped generally like one-half of an eggshell, being defined by a plurality of longitudinally extending bars 31-1 through 31-4 and a transverse bar 35. In accordance with the invention, the present invention includes means for detachably connecting the bottom end of back section 29 to the bottom end of front section 27. As embodied herein, said means includes a pair of prongs 37-1 and 37-2, which are disposed at the bottom end of front section 27 (see FIG. 4). As will be further described below, prongs 37 are designed to frictionally engage the bottom end of back section 29 so as to detachably fasten together the respective bottom ends of front section 27 and back section 29.

Also in accordance with the invention, the present invention includes means for securing microphone cable 21 between front section 27 and back section 29. As embodied herein, said means includes prongs 37 of front section 27, the bottom end of back section 29, and a projection 39 disposed on front section 27. Projection 39, which extends longitudinally a short distance from prongs 37 toward hinge 30, has a longitudinally extending groove 41 (see FIG. 4), which is adapted to receive and support microphone cable 21. As will be described in greater detail below, when microphone cable 21 is placed in groove 41 and the bottom end of back section 29 is brought into frictional engagement with prongs 37, microphone cable 21 is maintained securely against projection 39.

Back section 29, which is typically affixed to an article of clothing in the manner described below, is accordingly less rounded than front section 27. In the embodiment shown, back section 29 is a unitary structure, being defined by an outer pair of longitudinally extending bars 43-1 and 43-2 and an inner longitudinally extending bar 45, bar 45 having an arcuate portion 47 for elevating the cage 25 relative to underlying clothing. As alluded to earlier, the bottom end of back section 29 is sized and shaped to frictionally fit within prongs 37-1 and 37-2 so as to fasten together the bottom ends of front section 27 and back section 29 (see FIG. 4) and to fix microphone cable 21 against projection 39.

Figure 4:
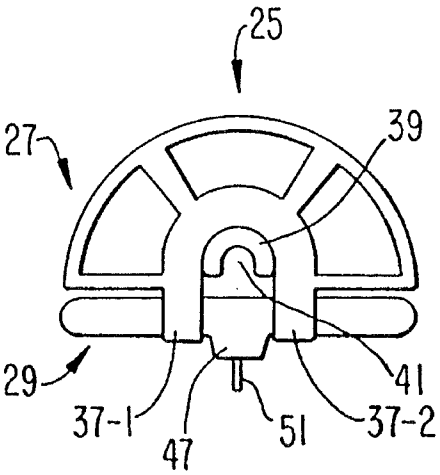
FIG. 4 is a bottom plan view of the microphone cage of the microphone assembly of FIG. 1, the microphone cage being shown in the closed position.

Microphone cage 25 further includes means for mounting back section 29 on an article of clothing. As shown in FIGS. 2 through 4, mounting means is preferably a straight pin 51, which is itself fixedly mounted by solder or other suitable means on arcuate portion 47 of bar 45.

To attach cage 25 to microphone cable 21, the microphone end of cable 21 is placed between prongs 37 and into groove 41 of projection 39 so that microphone 13 is roughly evenly spaced between hinge 30 and the top end of projection 39. Cage 25 is then fastened shut by pivoting back section 29 about hinge 30 until the bottom end of back section 29 frictionally engages prongs 37 of front section 27. With sections 27 and 29 so fastened, cable 21 is forced against projection 39, thereby securing cable 21 relative to cage 25.

So assembled, back section 29 may then be attached to an article of clothing using mounting pin 51.

Because of the caged construction of assembly 11, both ambient and mechanical interference are effectively minimized. Ambient interference is reduced because microphone 13 is spaced from clothing in all directions. Mechanical interference is reduced because microphone 13 is protected from direct contact with clothing. Additionally, cage 25 holds cable 21 in such a way as to effectively damp cable interference caused by direct contact with cable 21.

In another embodiment of the present invention, the rubber used to coat cage 25 is of a color selected to provide additional camouflaging effect to the assembly.

In still another embodiment of the present invention, cage 25 is a unitary structure, hinge 30 being an integrally formed hinge.

In still yet another embodiment of the present invention, the two concave frame sections are detachably fastened together at their bottom ends by means of a clasp assembly, snap assembly, nut/bolt assembly, tie assembly or other suitable means integrally formed or mounted to one or both frame sections. Either of the two frame sections may be shaped to accommodate the placement of the microphone cable so that fastening of the two sections causes the cable to be secured therebetween.

Although the present invention has been described in connection with preferred embodiments, it is understood that those skilled in the art are capable of making modifications and variations without departing from the scope or spirit of the present invention. Therefore, the foregoing description of preferred embodiments is not to be taken in a limiting sense, and the present invention is best defined by the following claims and their equivalents.

What is claimed is:

1. For reducing the ambient and mechanical interference of a microphone to be attached to clothing worn by an actor, an apparatus comprising:

a unitary concave front section of a microphone cage having a top end and bottom end and being defined by a transverse bar and a plurality of longitudinally extending bars between the top end and the bottom end;

a unitary concave back section of the cage having a top end and bottom end and being defined by an outer pair of longitudinally extending bars and an inner longitudinally extending bar that has an arcuate portion for elevating the cage relative to underlying clothing;

means for mounting the back section of the cage on an article of clothing;

a hinge pivotally connecting the top end of the front section of the cage to the top end of the bottom section;

means for detachably connecting the bottom end of back section of the cage to the bottom end of the front section of the cage, said detachably connecting means including a pair of prongs on the bottom end of the front section that are designed frictionally to engage the bottom end of the front section to the bottom end of the back section;

means for securing a microphone cable between the front section and the back section of the cage, said securing means including the prongs on the bottom end of the front section, the bottom end of the back section, and a projection on the front section that extends longitudinally a short distance from the prongs toward the hinge and that has a longitudinally extending groove adapted to receive and support a microphone cable and to hold the microphone cable securely against the projection when the microphone cable is placed in the groove and the bottom end of the back section is brought into frictional engagement with the prongs.

2. The apparatus of claim 1 wherein the means for mounting the back section on an article of clothing comprises a straight pin mounted on the arcuate portion of the inner bar of the back section.

3. The apparatus of claim 1 further comprising a microphone on the end of the cable that is approximately evenly spaced between the hinge and the top end of the projection.

* * * * *